US010548452B1

(12) United States Patent
Amaru

(10) Patent No.: US 10,548,452 B1
(45) Date of Patent: Feb. 4, 2020

(54) MOPPING DEVICE

(71) Applicant: Philip Amaru, Milton, MA (US)

(72) Inventor: Philip Amaru, Milton, MA (US)

( * ) Notice: Subject to any disclaimer, the term of this patent is extended or adjusted under 35 U.S.C. 154(b) by 83 days.

(21) Appl. No.: 15/992,466

(22) Filed: May 30, 2018

(51) Int. Cl.
*A47L 13/24* (2006.01)
*A47L 13/12* (2006.01)
*F04B 33/00* (2006.01)

(52) U.S. Cl.
CPC ..... *A47L 13/24* (2013.01); *A47L 13/12* (2013.01); *F04B 33/00* (2013.01)

(58) Field of Classification Search
CPC ..... A47L 13/24; A47L 13/12; F04B 33/00
See application file for complete search history.

(56) References Cited

U.S. PATENT DOCUMENTS 5,410,772 A 5/1995 Lewis
6,108,848 A * 8/2000 Monahan ..... A47L 13/14 15/119.1
6,212,728 B1 * 4/2001 Facca ..... A47L 13/142 15/120.1
6,286,172 B1 * 9/2001 Castagnoli ..... B08B 9/0436 15/104.16
7,269,875 B1 * 9/2007 Grimes ..... A47L 13/14 15/119.1
7,917,987 B2 * 4/2011 Kim ..... A47K 7/02 15/229.11
2002/0133892 A1 * 9/2002 Monahan ..... A47L 13/14 15/119.1
2003/0213079 A1 * 11/2003 Libman ..... A47L 13/14 15/119.1
2004/0231700 A1 * 11/2004 Bell ..... A47L 13/22 134/6
2008/0010767 A1 * 1/2008 Grimes ..... A47L 13/14 15/119.2

FOREIGN PATENT DOCUMENTS

WO WO-2010034904 A1 * 4/2010 ..... A47L 13/144

* cited by examiner

*Primary Examiner* — Marc Carlson
(74) *Attorney, Agent, or Firm* — Sanchelima & Associates, P.A.; Christian Sanchelima; Jesus Sanchelima

(57) ABSTRACT

The present invention is a mopping device with a cleaning head having cleaning bristles which can be adapted to be loosened or stiffened depending on the cleaning requirements. The mopping device includes a tubular rod with a shaft adapted to slide inside thereof and a piston at a lower end of the shaft. The shaft may be pushed inside the tubular rod, by pushing a handle, to pump air into air bladders of the cleaning bristles to make them stiff. Further, a cap is disposed which can be removed to vent out the pumped air to loosen the cleaning bristles. A high-pressure outlet valve and a spring-loaded check valve is utilized to check and aid with pumping of air. The mopping device can be utilized for washing purposes with the stiffened bristles and for dusting purposes with the loosened bristles.

16 Claims, 3 Drawing Sheets

MOPPING DEVICE

BACKGROUND OF THE INVENTION

1. Field of the Invention

The present disclosure generally relates to a cleaning device, and more particularly to a mopping device which can be adapted for both cleaning as well as dusting of surfaces.

2. Description of the Related Art

Mops of various designs have been developed over the years for cleaning purposes. For example, the conventional string or rope type mops absorb a substantial amount of water or a cleaning solution and are useful when a floor surface is to be washed. But these types of mops may not be efficient for cleaning, or specifically dusting of surfaces, like wall or ceiling surfaces, due to their bristles not having much rigidity. In other examples, the hard bristles type mops, that is, mops having hard bristles as the cleaning element, provide a more efficient scrubbing or dusting action than the string type mops. But these types of mops may not be efficient for cleaning of floor surfaces or the like, which involves using water and cleaning solutions.

Applicant believes a related reference corresponds to U.S. Pat. No. 5,410,772A (hereinafter referred to as "the '772 patent") which describes a floor washing mop having a rigid base carrying fixed scrubbing members on the bottom surface. The scrubbing members may be stiff flexible bristles or rigid elastomeric rails. A rabbet is formed at each side of the base stepped down from the upper surface of the base and a groove is stepped down from the upper surface and extends between the rabbets adjacent the front of the base. A U-shape clamp is pivoted to the base and receivable within the rabbets and the groove. A fabric covering is positionable about the entire base including the scrubbing members and foldable so as to rest on the top of the base and is held securely in position by the clamp. A locking member mounted on the upper surface of the base locks the clamp on the covering.

The floor washing mop of the '772 patent have a base on which either flexible or rigid scrubbing or massaging elements can be secured. However, interchanging the cleaning elements each time for switching from one type of cleaning to another would be cumbersome, and may also lead to failure of the mop over time with repeated changes of the attachment. Other documents describing the closest subject matter provide for a number of more or less complicated features that fail to solve the problems described above in an efficient and economical way. None of these patents suggest the novel features of the present invention.

SUMMARY OF THE INVENTION

It is one of the main objectives of the present invention to provide a mopping device which can be adapted for washing as well as dusting purposes.

It is another objective of the present invention to provide a mopping device which can be easily switched from washing mode to dusting mode without need of changing any mechanical attachments.

It is yet another objective of the present invention to provide a mopping device which is durable, inexpensive, and easy to handle.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
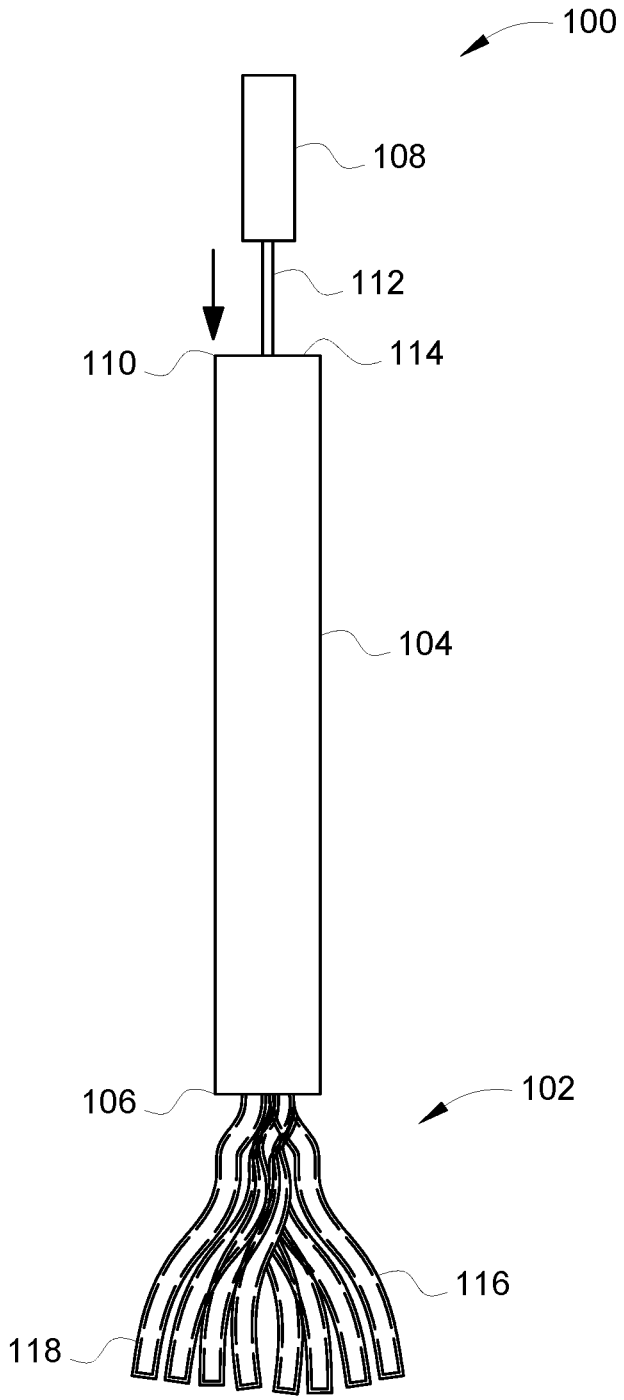
FIG. 1 illustrates a diagrammatic planar view of a mopping device 100 disposed in a washing mode with loosened cleaning bristles 116, in accordance with one or more embodiments of the present invention.

Referring to the drawings, FIG. 1 illustrate a diagrammatic view of a mopping device (referred by the numeral 100), in accordance with one or more embodiments of the present invention. The mopping device 100 is used to soak up liquid, for cleaning floors and other surfaces, to mop up dust, or for other cleaning purposes. That is, the mopping device 100 is designed to be used both as a dry-mop to pick up dry, loose contamination such as dust, earth, and sand from a surface; and as a wet-mop to wash a surface by sweeping it with water, and optionally some cleaning product such as a soap or the like. The mopping device 100 can be used for cleaning different types of surfaces, including a floor and hard to reach surfaces, such as a wall or a ceiling.

As illustrated in FIG. 1, the mopping device 100 includes a cleaning head 102 being disposed for contacting a floor or any other surface to be cleaned. In the mopping device 100, the cleaning head 102 is removably attached to a tubular rod 104 at its lower end 106. Further, the mopping device 100 includes a handle 108 disposed at an upper end 110 of the tubular rod 104. In particular, the mopping device 100 includes a shaft 112 slidably disposed with the tubular rod 104, and the handle 108 is attached to the shaft 112. Specifically, the shaft 112 is disposed to slide inside the tubular rod 104. The tubular rod 104 may have wall 114 formed at the upper end 110 to halt movement of the handle 108 beyond thereof, i.e. to inside of the tubular rod 104. The handle 108, as well as the tubular rod 104, may be shaped so as to be comfortably gripped by a user of the mopping device 100 for cleaning purposes. In one example, as illustrated, the handle 108 may also be cylindrical in shape and may have a diameter smaller or larger than the diameter of the tubular rod 104 without any limitations. Further, the tubular rod 104 may have a suitable length so as to allow a user to comfortably reach regular surfaces to be cleaned using the mopping device 100. In one example, the tubular rod 104 and the handle 108 may be made from a rigid material, such as plastic.

Further, as illustrated, the cleaning head 102 includes a plurality of cleaning bristles 116 which are made to scrub against the surface to apply friction for cleaning of the surface. In an example, the cleaning bristles 116 may be in the shape of strips made of some absorbent material, such as, but not limited to, cotton. In one exemplary configuration, the cleaning bristles 116 may be rectangular strips of about 2 inches in width. In an alternate configuration, the cleaning bristles 116 may be cylindrical strips of about 2 inches in diameter. In an embodiment of the present disclosure, the cleaning bristles 116 may include an air bladder 118 in the form of a closed tube formed inside thereof. The air bladder 118 may be adapted to expand on pumping of air inside thereof, thereby making the cleaning bristles 116 generally stiffened, or at least semi-rigid; and further the air bladder 118 may contract on pumping or sucking out of the air therefrom, thus making the cleaning bristles 116 generally loosened. FIG. 1 depicts the mopping device 100 having the cleaning head 102 with the loosened cleaning bristles 116, so as be utilized in a washing mode.

Figure 2:
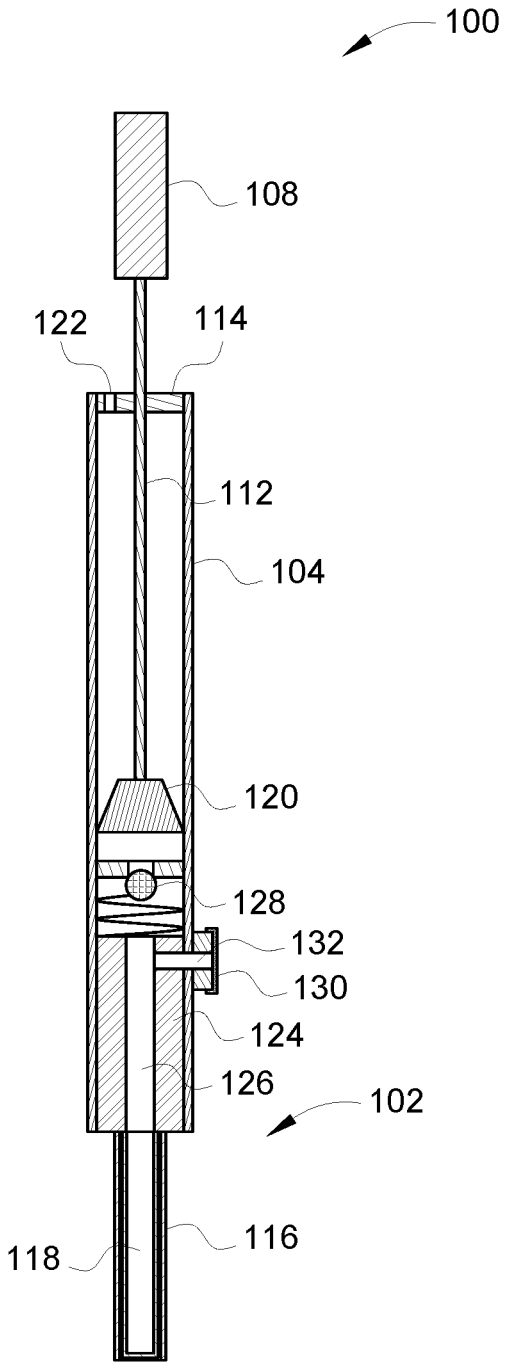
FIG. 2 illustrates a diagrammatic sectional view of the mopping device 100 taken along a tubular rod 104 thereof, in accordance with one or more embodiments of the present invention.

Referring now to FIG. 2, a cross-section view of the mopping device 100 is depicted. As illustrated, the tubular rod 104 sleeves the shaft 112 having a piston 120 attached to a lower end thereof and the handle 108 attached to an upper end thereof. Further, as illustrated, the shaft 112 passes centrally though the wall 114 which closes off the upper end of the tubular rod 104. As shown, the wall 114 may provide a vent hole 122 therein. Further, a high-pressure outlet valve 124, having a central passage 126 of decreased diameter extending longitudinally therethrough, is provided in the tubular rod 104. In some examples, a spring-loaded check valve 128 is positioned in the tubular rod 104 immediately below the lower end of the piston 120 and the upper end of the outlet valve 124 to prevent the back flow of air. Further, in some examples, a cap 130 is removably fixed to the tubular rod 104 adjacent the upper end of the outlet valve 124 to allow air from the high pressure side of the air pump to be vented to atmosphere, via the passage 132.

Further, as illustrated in FIG. 2, the cleaning head 102 is attached to the central passage 126 of the outlet valve 124. Specifically, the cleaning head 102 is attached such that the air bladder 118 of the cleaning bristles 116 may be in fluid communication with the outlet valve 124 to receive pumped air. In FIG. 2, only one cleaning bristle 116 is shown for simplification purposes. As may be contemplated by a person skilled in the art, the handle 108 serves as a cylinder for the piston 120, and the handle 108 and the piston 120 may together act as an air pump. Therefore, when the handle 108 is pushed towards the tubular rod 104 (as represented in FIG. 1), the piston 120 pushes the pressurized air to be pumped into the air bladder 118 of the cleaning bristles 116, thereby making the cleaning bristles 116 stiffened.

Figure 3:
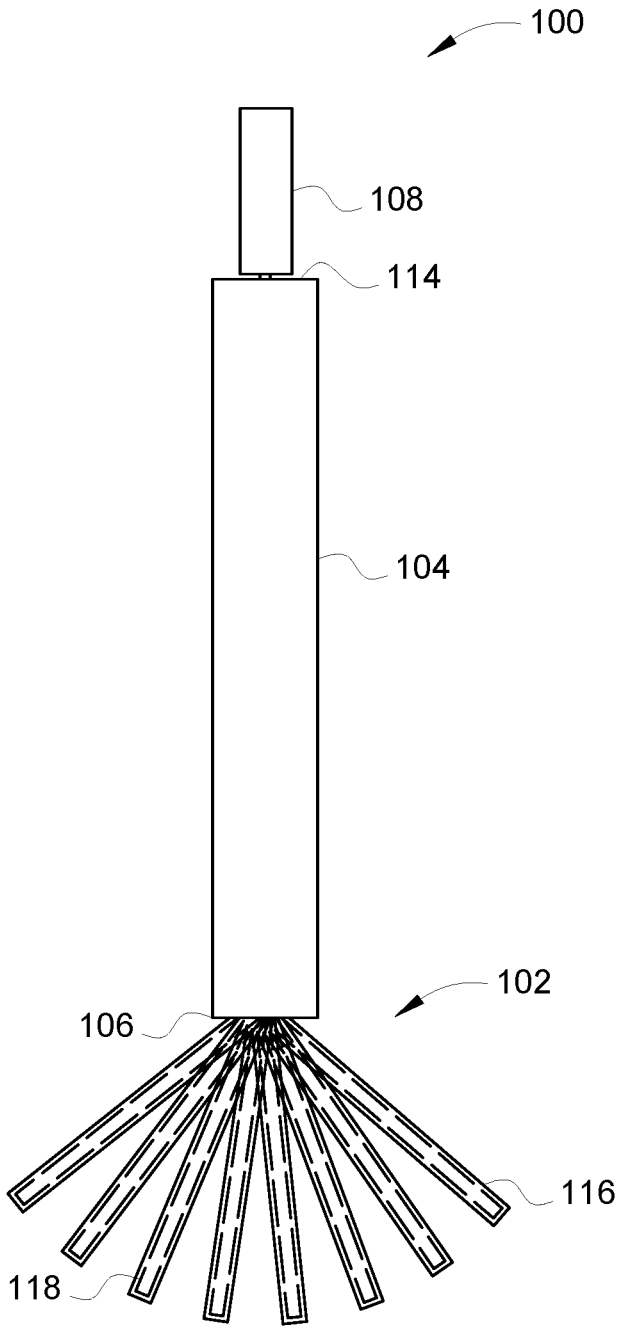
FIG. 3 illustrates a diagrammatic planar view of the mopping device 100 disposed in a dusting mode with stiffened cleaning bristles 116, in accordance with one or more embodiments of the present invention.

FIG. 3 illustrates the mopping device 100 with the handle 108 pushed to the wall 114 of the tubular rod 104, thus filling the air bladder 118 of the cleaning bristles 116 with air and making the cleaning bristles 116 stiffened. It may be understood that with the stiffened cleaning bristles 116, the mopping device 100 can be utilized in the dusting mode, that is to brush up dust from walls and ceiling surfaces; and further to wash hard to reach places. In operation, the user may push the handle 108 downwards to make the cleaning bristles 116 stiff, and pull the handle 108 upwards to loosen the cleaning bristles 116; thus switching the mopping device 100 from one mode to another. Alternatively, the user may open the cap 130 in order to allow air from the air bladder 118 to vent out to the atmosphere via the passage 132, thus making the cleaning bristles 116 loosened.

In some alternate examples, the air pump may be implemented by attaching an external pump for pumping air into the air bladders 118 of the cleaning bristles 116 in the cleaning head 102. For example, the external pump may be attached to the handle 108 to pump air therefrom. Further, in such example, the handle 108 may be rotated/twisted to allow air to vent out. While a manually operated pump has been shown and described, an electrically-operated pump may alternatively be employed without any limitations.

The mopping device 100 of the present disclosure can be utilized for cleaning of any type of surfaces. In particular, the mopping device 100 may be utilized in washing mode with the loosened bristles for washing of floor surfaces, and in the dusting mode with stiffened bristles for dusting or cleaning of the walls or ceilings, and for reaching hard to reach places. The mopping device 100 of the present disclosure can be used by households, business, boat owners, etc. for cleaning purposes.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mopping device, comprising:

a tubular hollow rod having a top distal end and a lower distal end, a removably attached cleaning head mounted to said lower end, a shaft slidably disposed inside said rod, said shaft extending out of said top distal end and connected to a handle, an opening at said top distal end configured to allow said shaft to pass through, a wall surrounding filling said opening a predetermined amount sufficient to keep said handle in place, said cleaning head includes absorbent bristles adapted to scrub against a surface, said bristles each including an air bladder that is adapted to be inflated upon air being pumped and making the bristles semi-rigid or rigid and upon said air bladder being deflated said bristles are loosened.

2. The mopping device of claim 1 wherein said handle includes a gripping member.

3. The mopping device of claim 1 wherein said handle is made of a rigid material.

4. The mopping device of claim 1 wherein said bristles are cylindrical strips.

5. The mopping device of claim 1 wherein said bristles are rectangular strips.

6. The mopping device of claim 1 wherein said wall includes a vent hole.

7. The mopping device of claim 1 wherein a high-pressure outlet valve having a central passage of decreased diameter extends longitudinally within said rod.

8. The mopping device of claim 1 wherein a spring-loaded check valve is positioned in the tubular rod between said piston and said outlet valve to prevent back flow.

9. The mopping device of claim 1 wherein a cap is removably mounted to the tubular rod and is configured to allow air from said bladders in inflated form out of said rod through said central passage and into the atmosphere via a venting passage.

10. The mopping device of claim 9 wherein said central passage and said venting passage are perpendicular.

11. The mopping device of claim 1 wherein each of said air bladder is connected to an inflation/deflation valve through said central passage.

12. The mopping device of claim 11 wherein said inflation/deflation valve is a boston valve.

13. The mopping device of claim 11 wherein said inflation/deflation valve is a military valve being a spring-loaded push-pin style valve.

14. The mopping device of claim 11 wherein said inflation/deflation valve is a twist-lock valve.

15. The mopping device of claim 11 wherein said inflation/deflation valve is a pinch valve.

16. The mopping device of claim 11 wherein said inflation/deflation valve is delivered compressed air using a manual or electric air pump.

* * * * *